US010428501B2

(12) United States Patent
Kuo

(10) Patent No.: US 10,428,501 B2
(45) Date of Patent: Oct. 1, 2019

(54) DRAINAGE ASSEMBLY FOR A BATHTUB

(71) Applicants: Kuang-Ming Kuo, New Taipei (TW); BRIDGING PARTNERS CORPORATION, Taipei (TW)

(72) Inventor: Kuang-Ming Kuo, New Taipei (TW)

(73) Assignees: Kuang-Ming Kuo, New Taipei (TW); Bridging Partners Corporation, Taipei (TW)

( * ) Notice: Subject to any disclaimer, the term of this patent is extended or adjusted under 35 U.S.C. 154(b) by 0 days.

(21) Appl. No.: 15/645,024

(22) Filed: Jul. 10, 2017

(65) Prior Publication Data

US 2019/0010684 A1 Jan. 10, 2019

(51) Int. Cl.
*E03C 1/23* (2006.01)
*E03C 1/20* (2006.01)

(52) U.S. Cl.
CPC ..... *E03C 1/2302* (2013.01); *E03C 1/20* (2013.01)

(58) Field of Classification Search
CPC ..... E03C 1/2302
USPC ..... 4/679–680
See application file for complete search history.

(56) References Cited

U.S. PATENT DOCUMENTS 2,063,399 A * 12/1936 Rasmussen ..... E03C 1/2304 137/605
2,649,825 A * 8/1953 Fisher ..... B25B 13/48 29/213.1
4,411,054 A * 10/1983 Zeilenga ..... B25B 27/023 269/49
5,394,572 A * 3/1995 Humphreys ..... E03C 1/232 4/683
7,946,012 B2 * 5/2011 Cox ..... B25B 27/14 29/255
2006/0253975 A1 * 11/2006 Rogers ..... E03C 1/20 4/688
2015/0089736 A1 * 4/2015 Bird ..... E03C 1/22 4/680

* cited by examiner

*Primary Examiner* — Christine J Skubinna
(74) *Attorney, Agent, or Firm* — Rosenberg, Klein & Lee

(57) ABSTRACT

A drainage assembly for a bathtub includes a stopper unit having a base including a drain passage and a lock hole defined through a bottom thereof. A drain pipe includes a tub shoe at one end thereof and the tub shoe communicates with the drain passage. An extension extends from the inner bottom of the tub shoe. A guide member includes a rod which includes a first connection portion formed on the first end of the rod, and a hook formed on the second end of the rod. The first connection portion is detachably connected to the extension to extend the rod through the lock hole so as to align the tub shoe with the base, and to connect the outer threads of the base with the inner threads of the tub shoe easily.

4 Claims, 18 Drawing Sheets

DRAINAGE ASSEMBLY FOR A BATHTUB

BACKGROUND OF THE INVENTION

1. Fields of the Invention

The present invention relates to a drainage assembly, and more particularly, to a drainage assembly for a bathtub.

2. Descriptions of Related Art

The conventional drainage assembly for a bathtub is disclosed in FIGS. 1 and 2, and comprises a stopper unit 10 which includes a cover 11, a stopper 13 and a base 20. Referring to FIGS. 2 and 4, the cover 11 is threadedly connected to the center of the stopper 13 which includes a tube 131 extending from the center thereof. A seal 132 is installed in the tube 131. An axle 14 is inserted through tube 131 and the seal 132. The top end of the axle 14 is covered by the cover 11, and the bottom end of the axle 14 is a threaded end 141. A wave-shaped resilient plate 16 is mounted to the axle 14 and located beneath the stopper 13. The base 20 includes outer threads 21 on outside thereof, and a drain hole 22 is formed in the base 20. The inner diameter of the drain hole 22 is smaller than the outer diameter of the stopper 13. The base 20 further includes a flange 23 extending from the top thereof, and a cross-shaped rib 221 is formed at the bottom thereof. A lock hole 222 is defined in the center of the cross-shaped rib 221 so that the threaded end 141 of the axle 14 is threadedly connected to the lock hole 222. The stopper 13 can be pushed to contact against the flange 23 to seal the drain hole 22.

As shown in FIGS. 3 and 4, the stopper unit 10 is installed and connected to the drain pipe 35 of the bathtub 30. The drain pipe 35 includes a tub shoe 36 on one end thereof and the tub shoe 36 includes inner threads 361 to be connected with the outer threads 21 of the base 20. A washer 37 is put on the top of the tub shoe 36 and in contact with the wall of the hole 31 of the bathtub 30. The base 20 is inserted into the hole 31 and the outer threads 21 of the base 20 are connected to the inner threads 361 of the tub shoe 36, so that the base 20 is combined with the drain pipe 35, and the flange 23 of the base 20 and the stopper 13 are exposed beyond the hole 31. The flange 23 presses the top of the bottom wall of the bathtub 30 and is located around the hole 31. The base 20 is inserted into the hole 31 of the bathtub 30.

When pushing the cover 11 downward, the cover 11 is moved downward along the axle 14, and the stopper 13 seals the drain hole 22. The resilient plate 16 is deformed to store an energy. On the contrary, when pushing the cover 11 again, the energy of the resilient plate 16 is released to push the stopper 13 to move upward along the axle 14 to open the drain hole 22, water in the bathtub 30 drains out from the drain pipe 35 via the gap between the stopper 13 and the flange 23, the drain hole 22, the tub shoe 36 and the drain pipe 35.

However, as shown in FIGS. 5 to 7, the tub shoe 36 is tilt because the drain pipe 35 is an elongate pipe. There is no proper tool to hold the drain pipe 35 from the hole 31, so that the when installing the stopper unit 10, the tub shoe 36 is not easily to be in alignment with the base 20. This is because the drain pipe 35 is not well supported and positioned, so that the outer threads 21 of the base 20 are not conveniently connected to the inner threads 361 of the tub shoe 36.

The present invention intends to provide a drainage assembly for a bathtub by using a guide member which is detachably hooked to the drain pipe to easily align the stopper and the tub shoe.

SUMMARY OF THE INVENTION

The present invention relates to a drainage assembly for a bathtub, and comprises a stopper unit having a base with outer threads. The base includes a drain passage and a lock hole is defined through the bottom thereof. A drain pipe includes a tub shoe at one end thereof and the tub shoe communicates with the drain passage. The tub shoe 36 includes inner threads defined in an inner periphery thereof. An extension extends from the inner bottom of the tub shoe. A guide member is an elongate member and includes a rod whose diameter is smaller than the inner diameter of the lock hole. A first connection portion is formed on the first end of the rod, and the first connection portion is detachably connected to the extension to extend the rod of the guide member through the lock hole so as to align the tub shoe with the base, and to connect the outer threads of the base with the inner threads of the tub shoe.

The advantages of the present invention are that the tub shoe includes an extension, and a guide member which is detachably connected to the extension when installing the base to the tub shoe. The guide member is inserted into the base and is detachably connected to the extension to easily guide the tub shoe to be in alignment with the base. The base is easily connected to the tub shoe. The guide member is then separated from the extension to allow other parts to be installed. The drain pipe with the tub shoe is well guided and supported so as to be guided toward the base. The connection between the drain pipe and the base is easy, precise and effective to reduce time required.

The extension may have different types, and the guide member includes a first connection portion and a second connection portion. Either one of the first and second connection portions is able to be connected with the extension.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
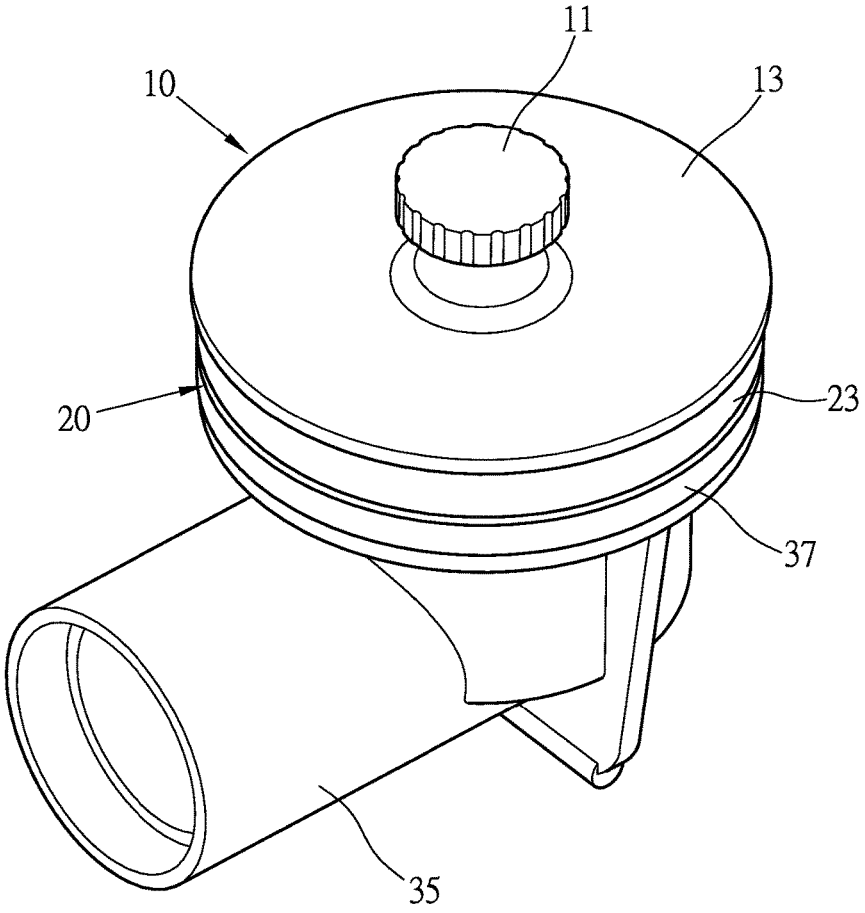
FIG. 1 is a perspective view to show a conventional drainage assembly.
Figure 2:
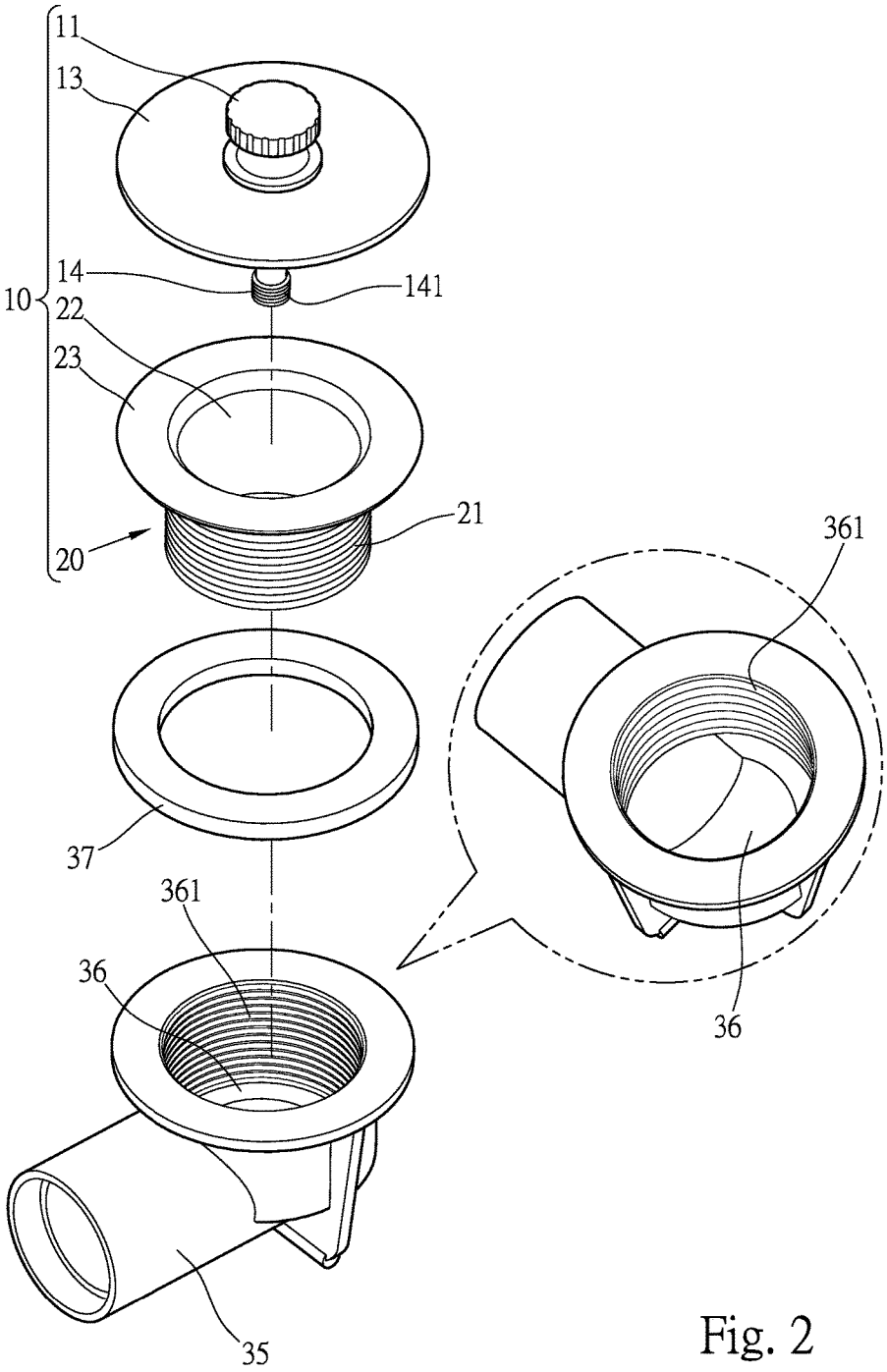
FIG. 2 is an exploded view of the conventional drainage assembly.
Figure 3:
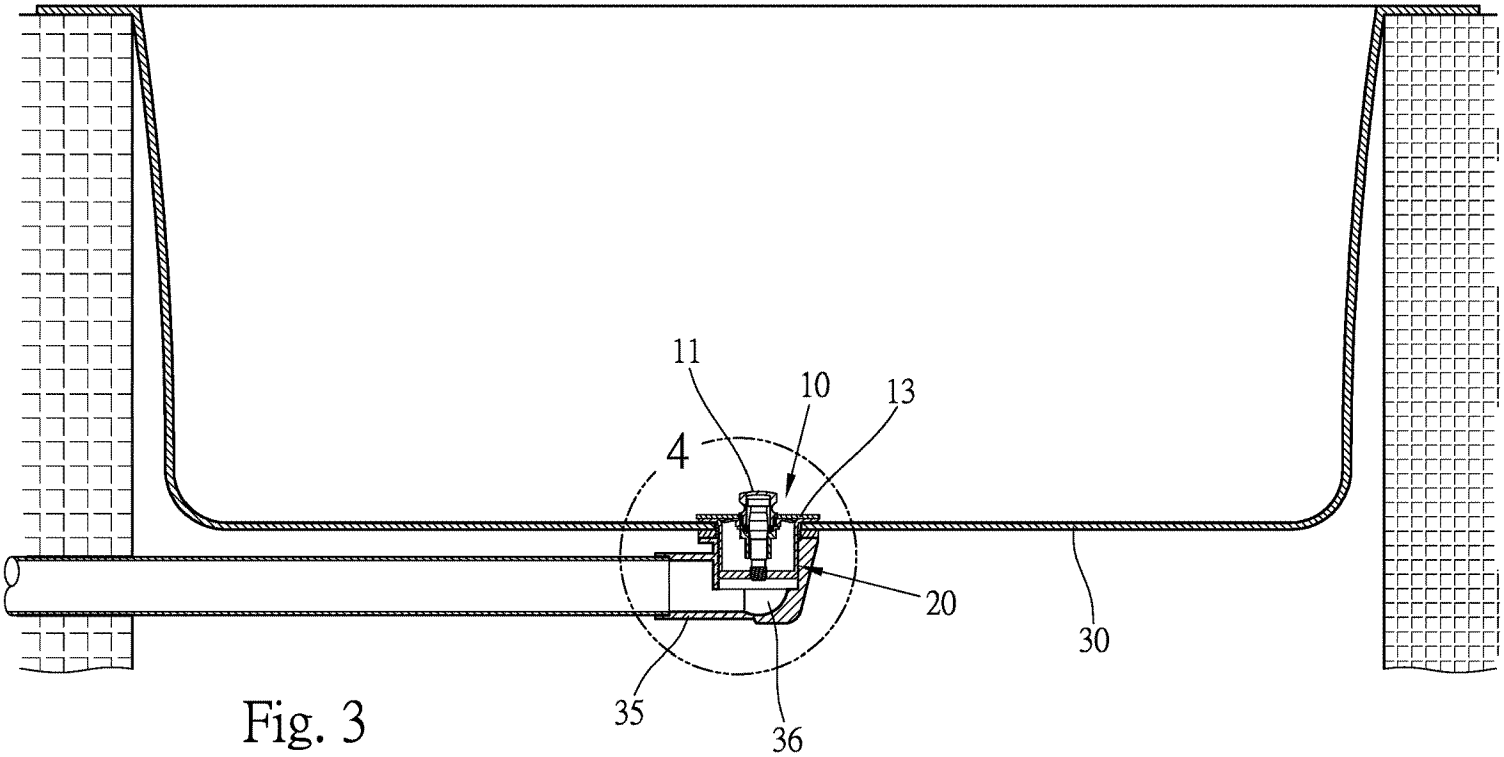
FIG. 3 is a side cross sectional view to show the conventional drainage assembly is installed to a bathtub.
Figure 4:
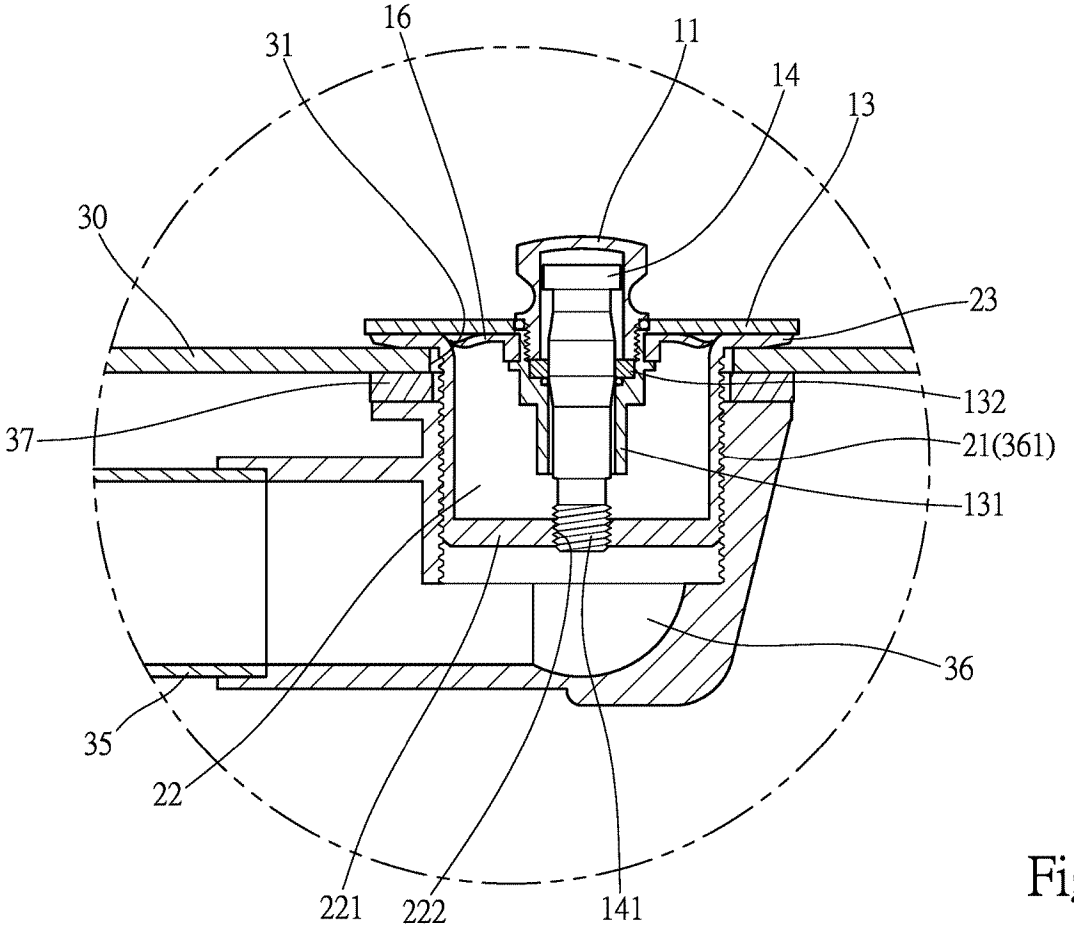
FIG. 4 is an enlarged view of the circled 4 in FIG. 3.
Figure 5:
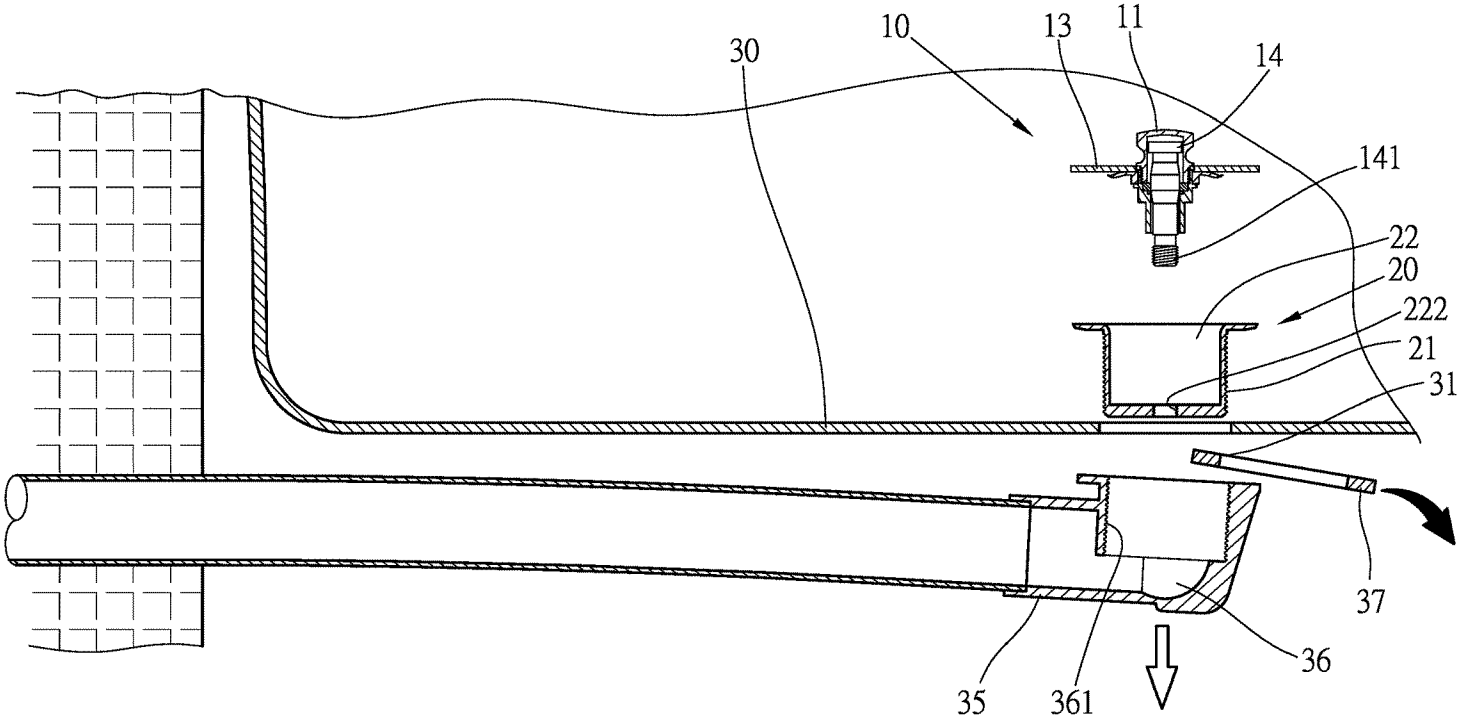
FIG. 5 is a side cross sectional view to show one status of the conventional drainage assembly is installed to a bathtub.
Figure 6:
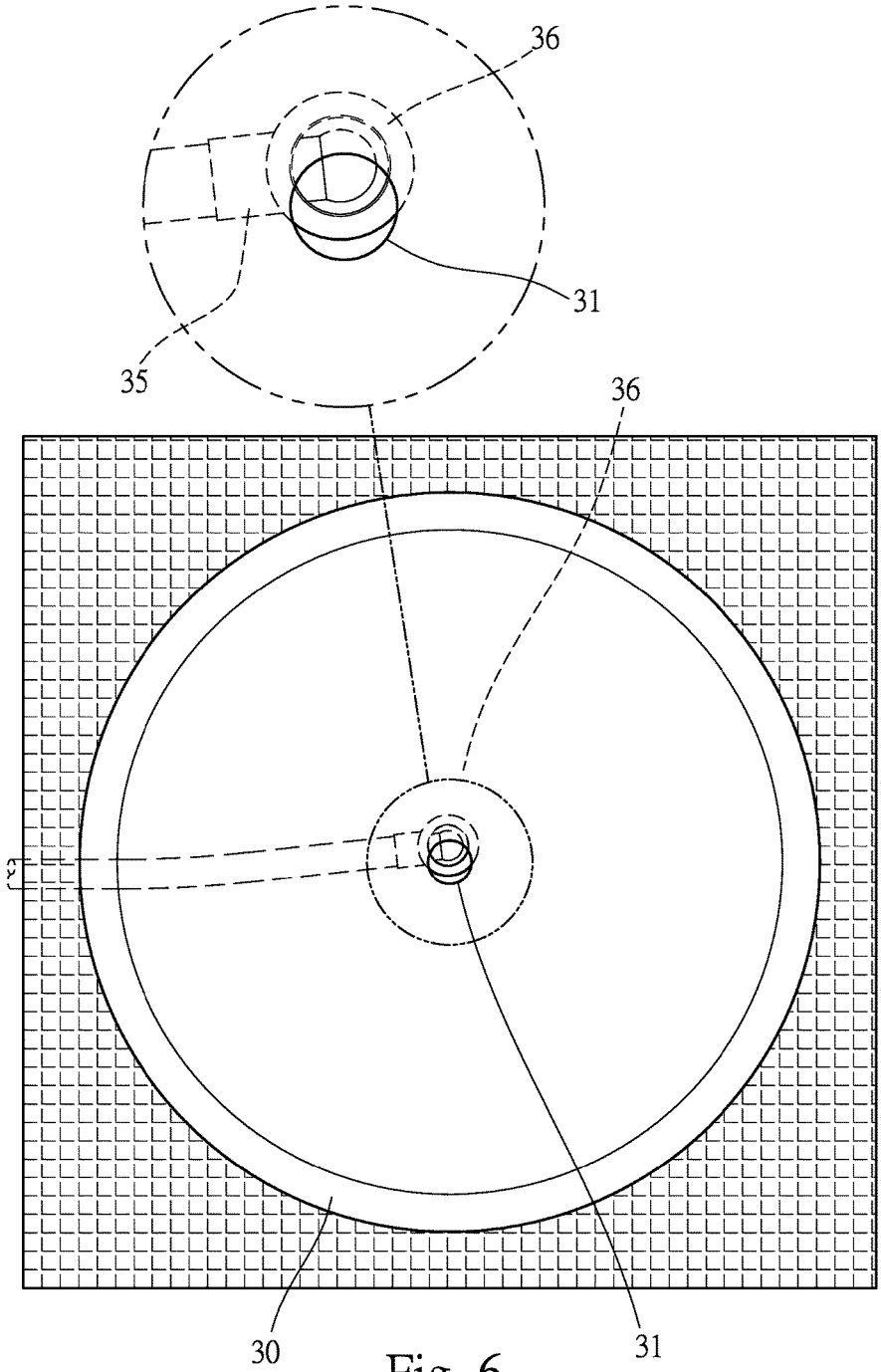
FIGS. 6 and 7 respectively show that the tub shoe and the base of conventional drainage assembly are not located in alignment with each other.
Figure 7:
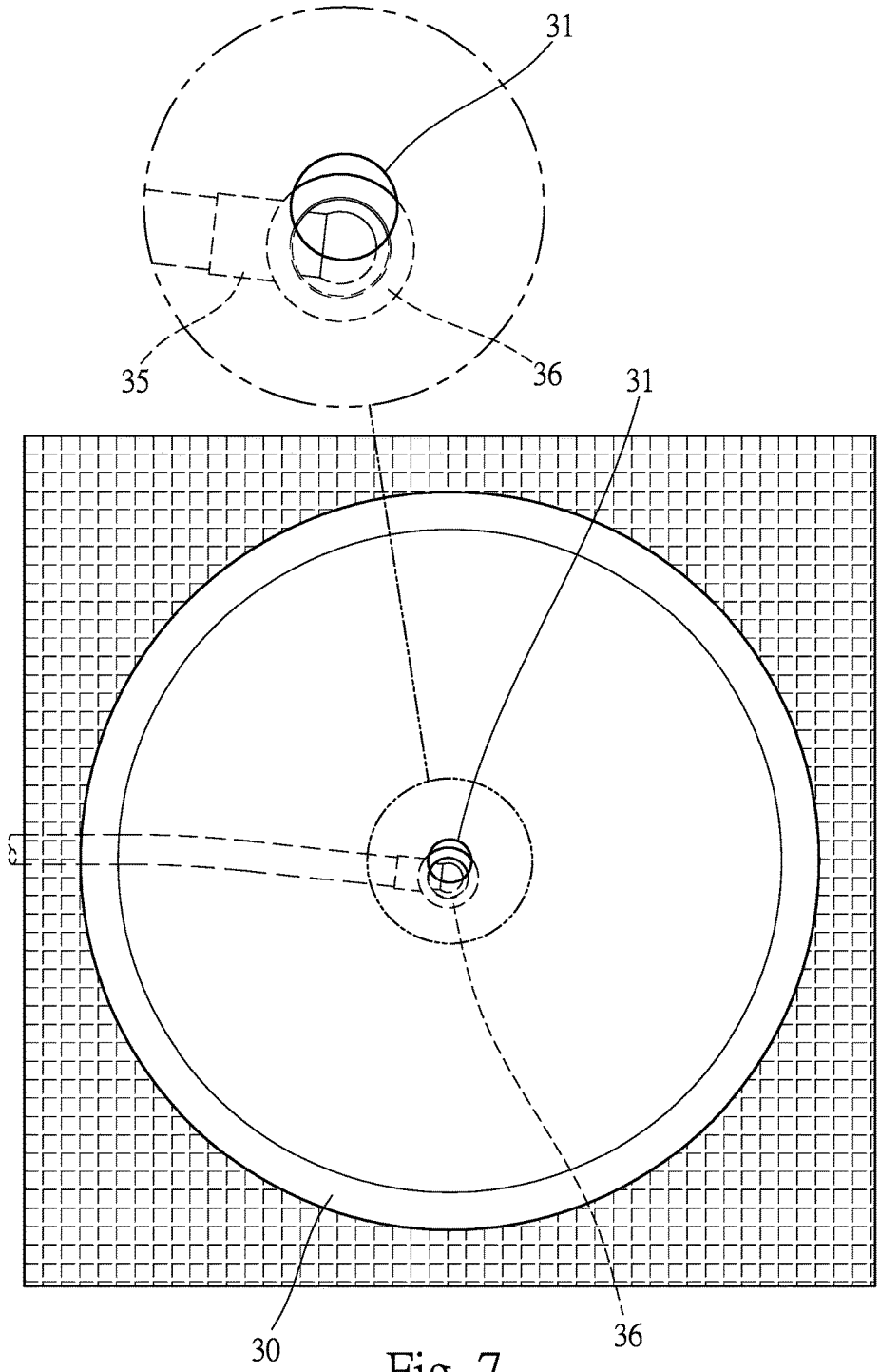
Figure 8:
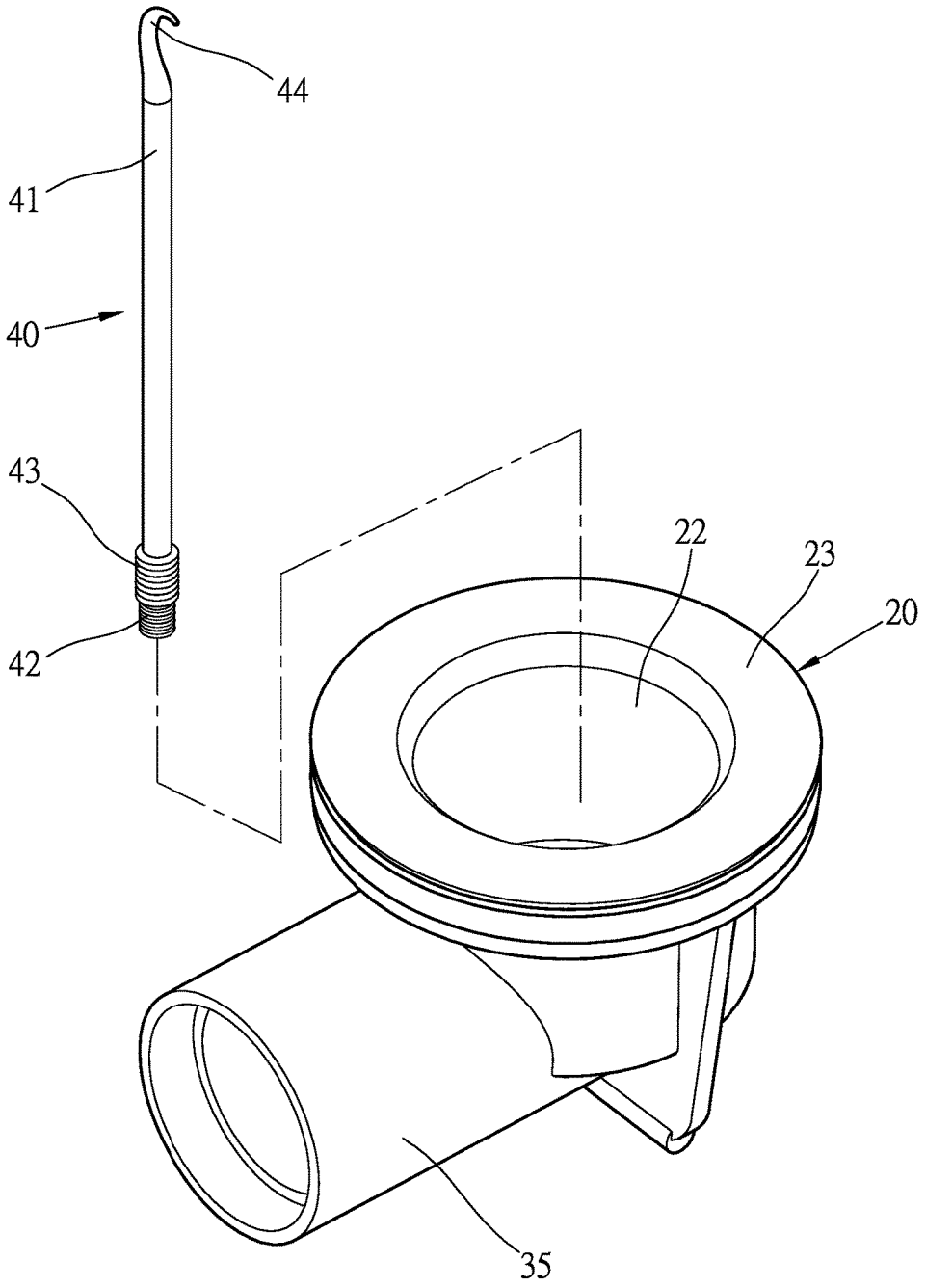
FIG. 8 shows the guide member and the drainage assembly of the present invention.
Figure 9:
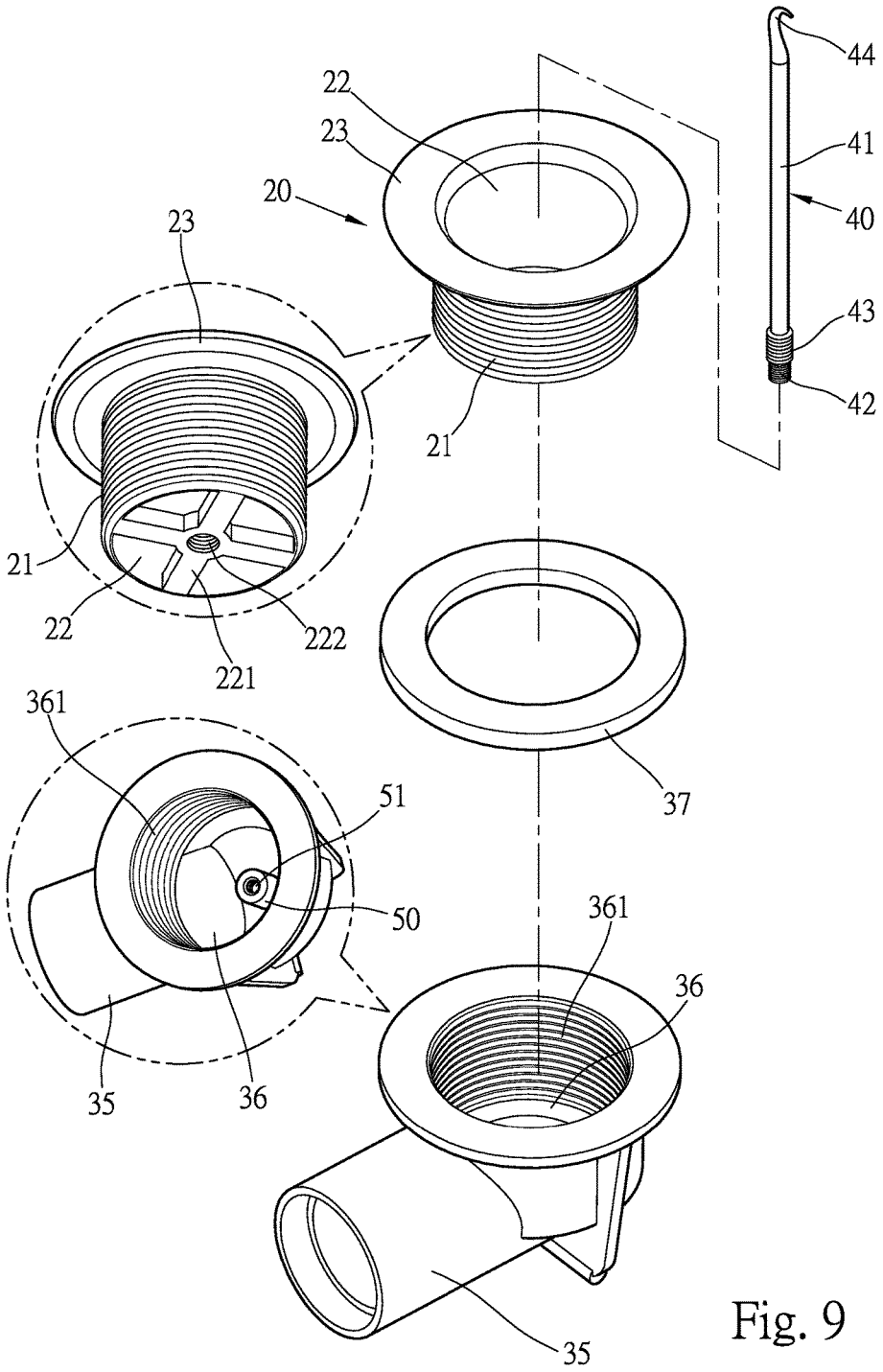
FIG. 9 is an exploded view of the drainage assembly of the present invention.

Referring to FIGS. 8 and 9, the drainage assembly of the present invention comprises a stopper unit 10 having a base 20 with outer threads 21. The base 20 includes a drain passage 22. The base 20 includes a flange 23 extending from the top thereof, and a cross-shaped rib 221 is formed at the bottom thereof. A lock hole 222 is defined in the center of the cross-shaped rib 221 so that the threaded end 141 of the axle 14 of the stopper unit 10 is threadedly connected to the lock hole 222. The stopper 13 can be pushed to contact against the flange 23 to seal the drain hole 22. The cover 11 is threadedly connected to the center of the stopper 13.

A drain pipe 35 comprises a tub shoe 36 at one end thereof and the tub shoe 36 communicates with the drain passage 22 when the base 20 is connected to the tub shoe 36. The tub shoe 36 includes inner threads 361 defined in the inner periphery thereof, and an extension 50 extends from the inner bottom of the tub shoe 36. The extension 50 includes a threaded hole 51 defined in the distal end thereof.

A guide member 40 is an elongate member and includes a rod 41 whose diameter is smaller than the inner diameter of the lock hole 222. A first connection portion 42 is formed on the first end of the rod 41. The first connection portion 42 of the rod 41 is a cylindrical end with outer threads. A second connection portion 43 is formed on the rod 41 and located axially next to the first connection portion 42. The second connection portion 43 is a cylindrical section with outer threads. The diameter of the second connection portion 43 is larger than that of the first connection portion 42.

Figure 10:
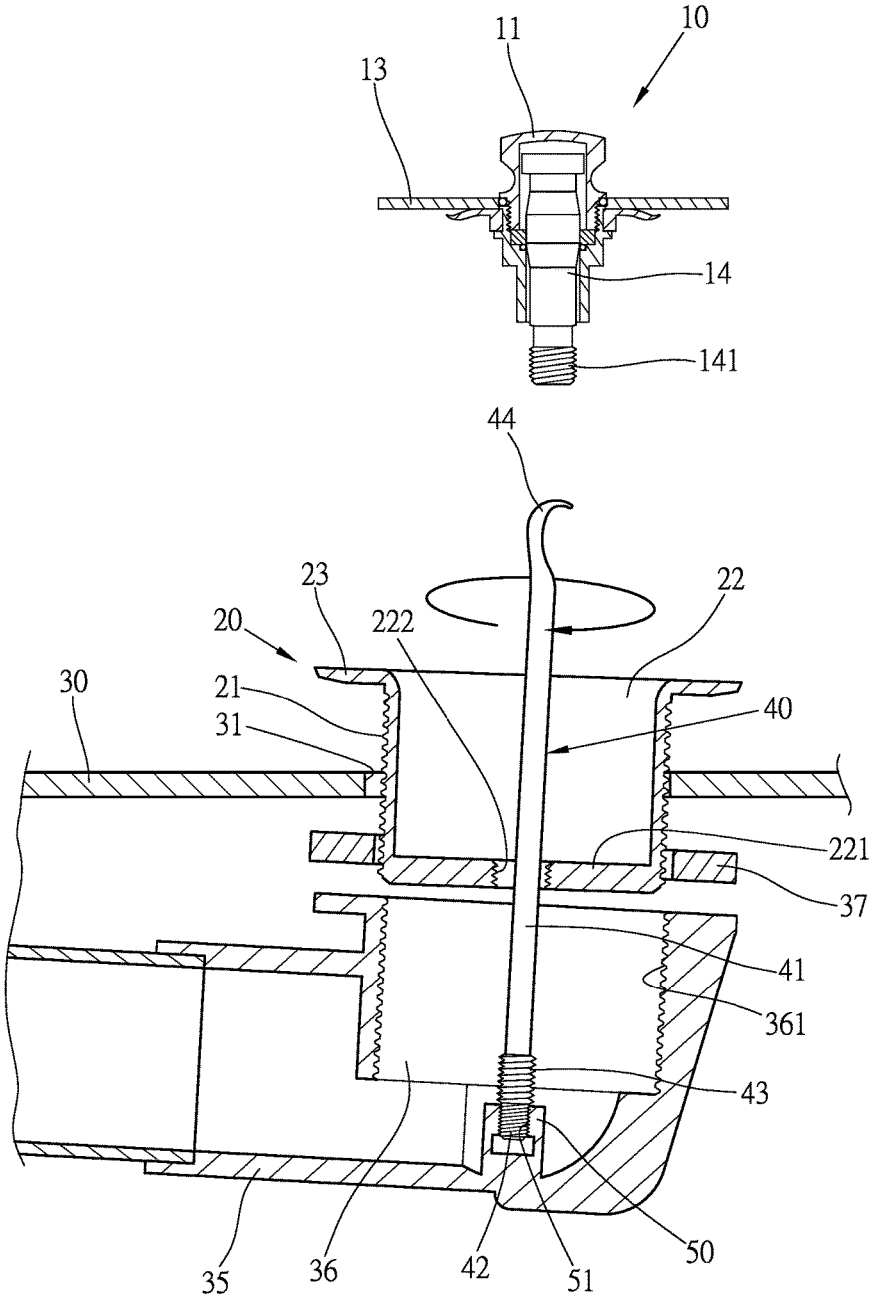
FIG. 10 shows that the guide member extends through the base and is connected to the tub shoe.
Figure 11:
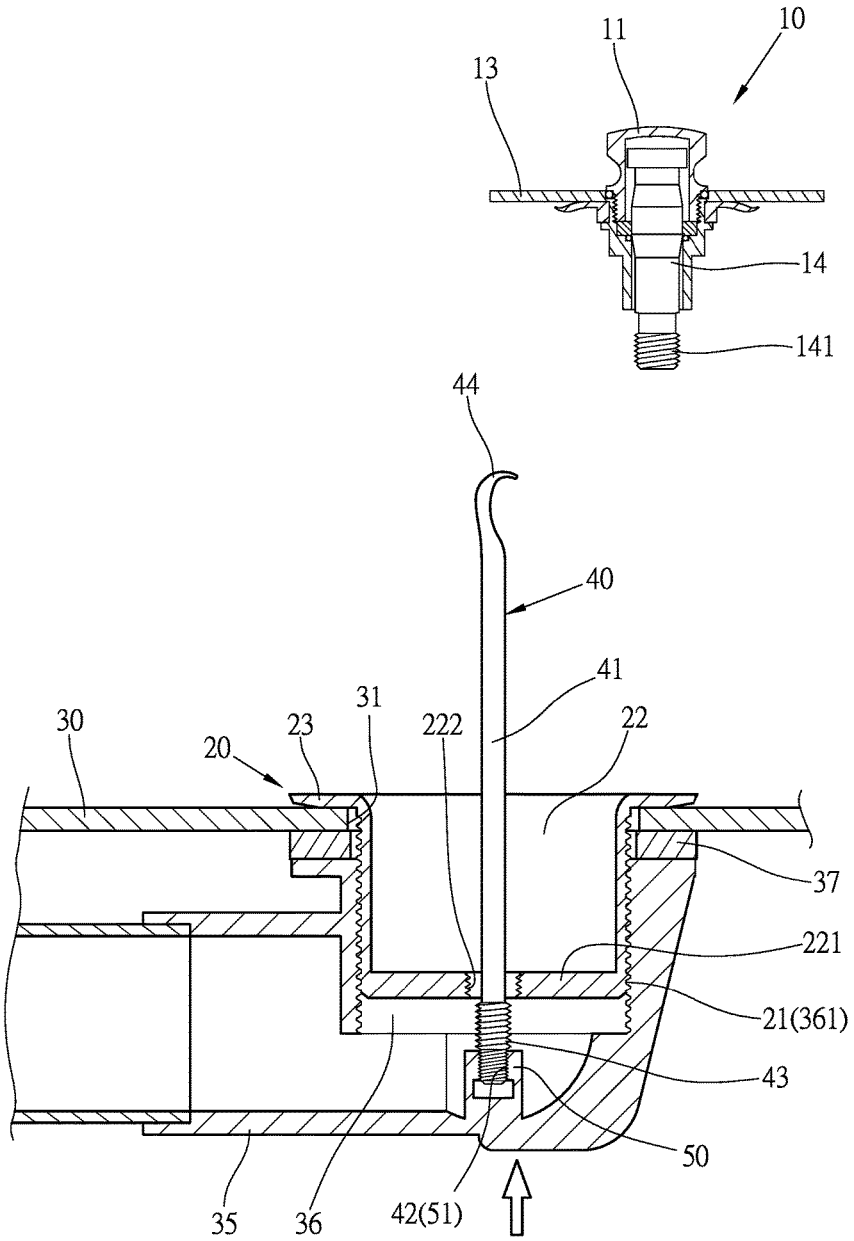
FIG. 11 shows that the tub shoe is pulled toward the base.
Figure 12:
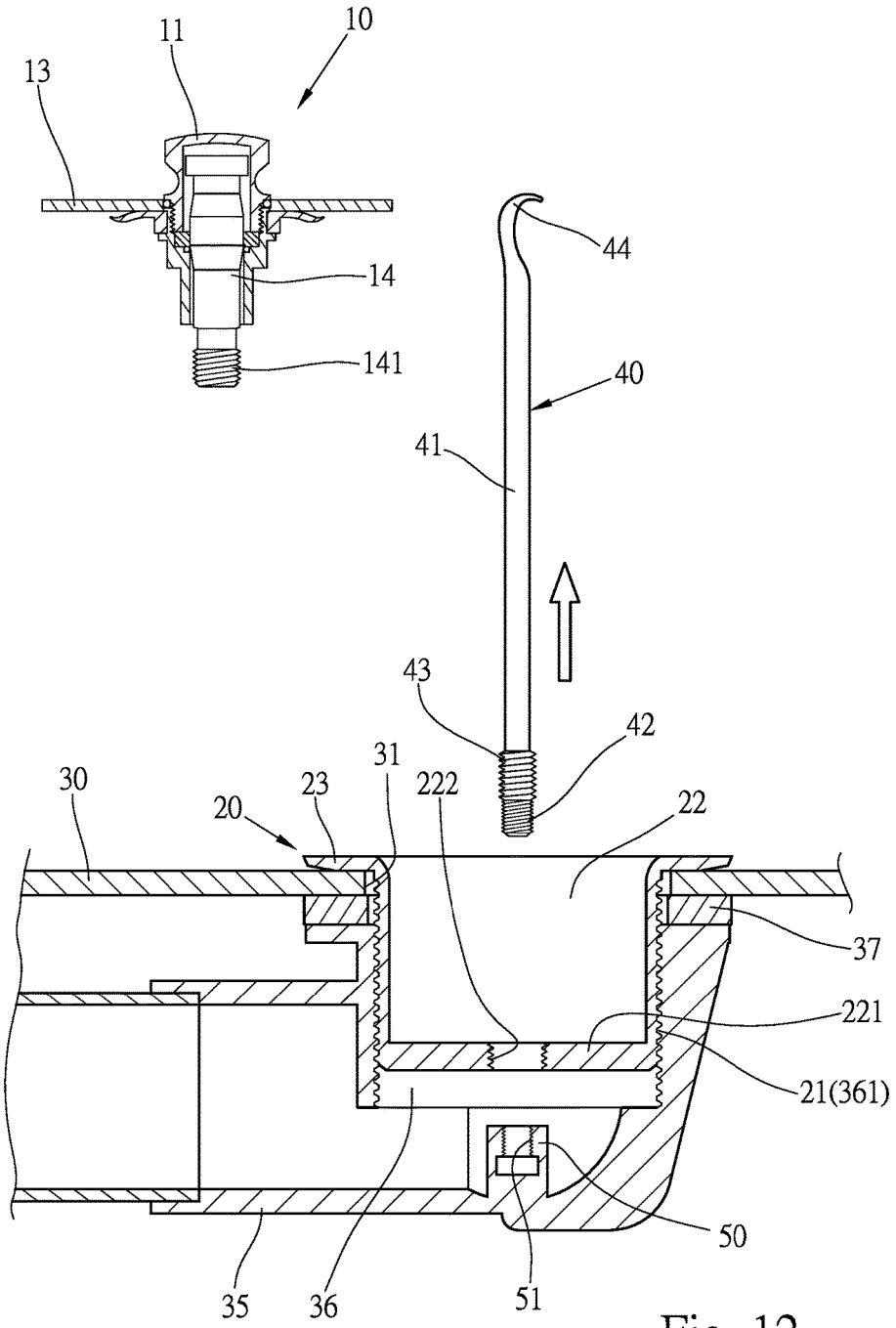
FIG. 12 shows that the guide member is removed when the base is connected to the tub shoe.
Figure 13:
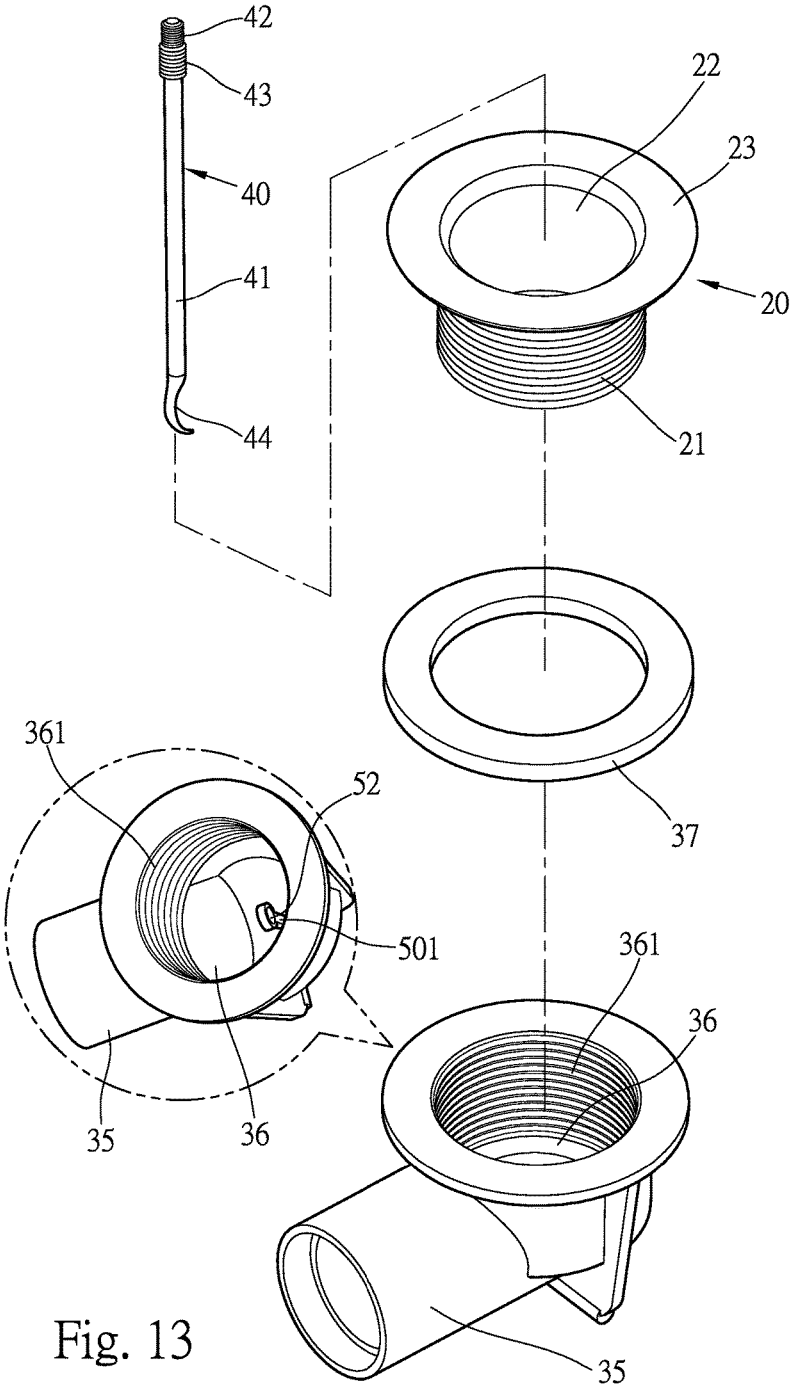
FIG. 13 is an exploded view to show the second embodiment of the drainage assembly of the present invention.
Figure 14:
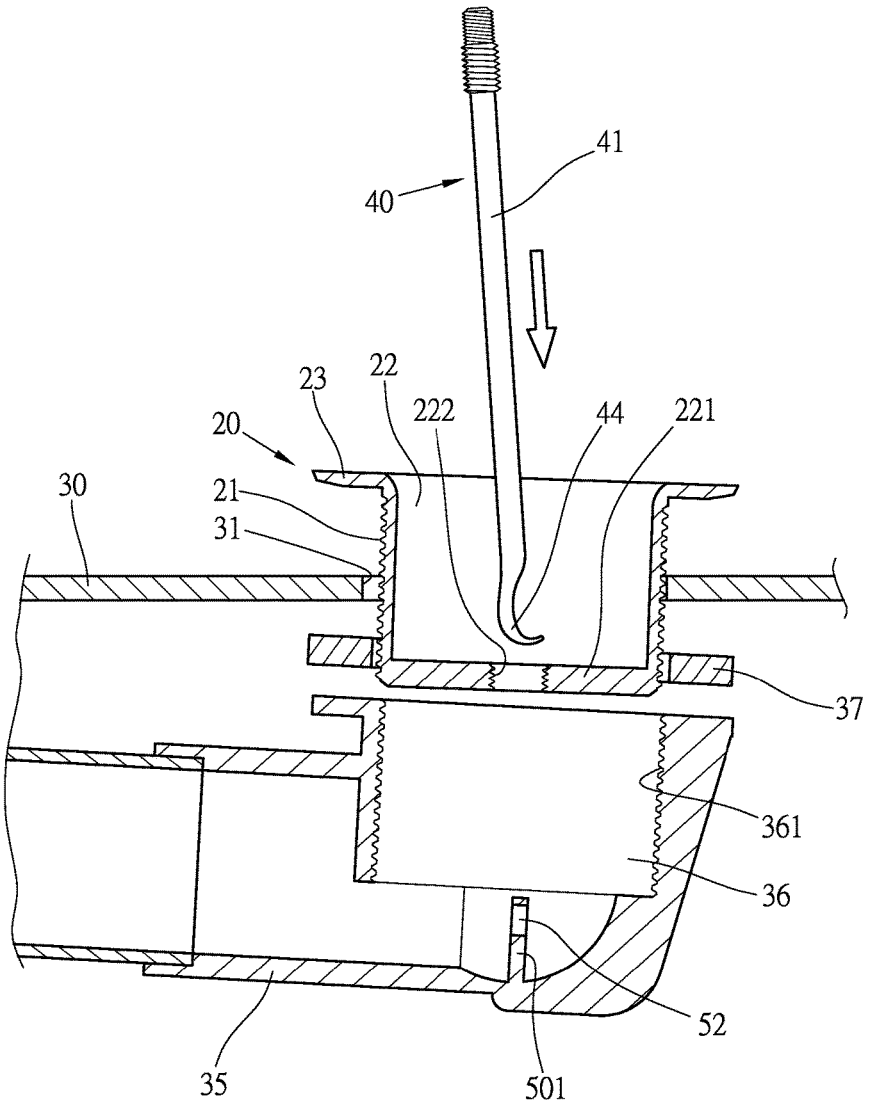
FIG. 14 shows that the guide member extends through the base and to be connected to the extension of the tub shoe of the second embodiment of the drainage assembly of the present invention.
Figure 15:
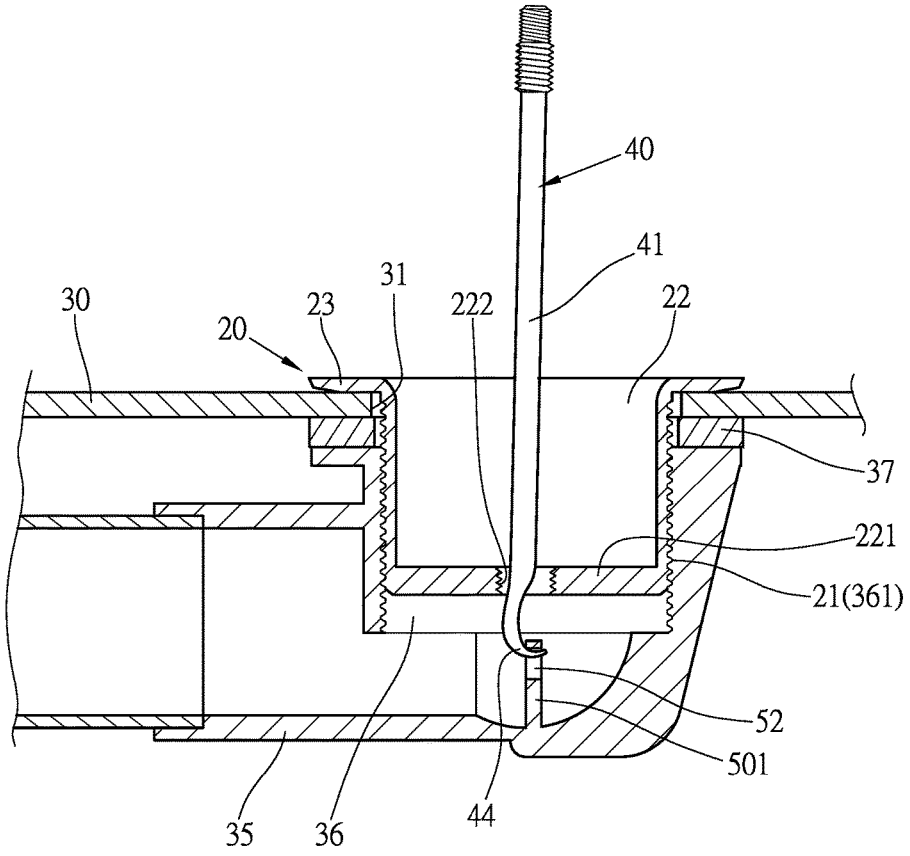
FIG. 15 shows that the guide member is hooked to the extension of the tub shoe of the second embodiment of the drainage assembly of the present invention.
Figure 16:
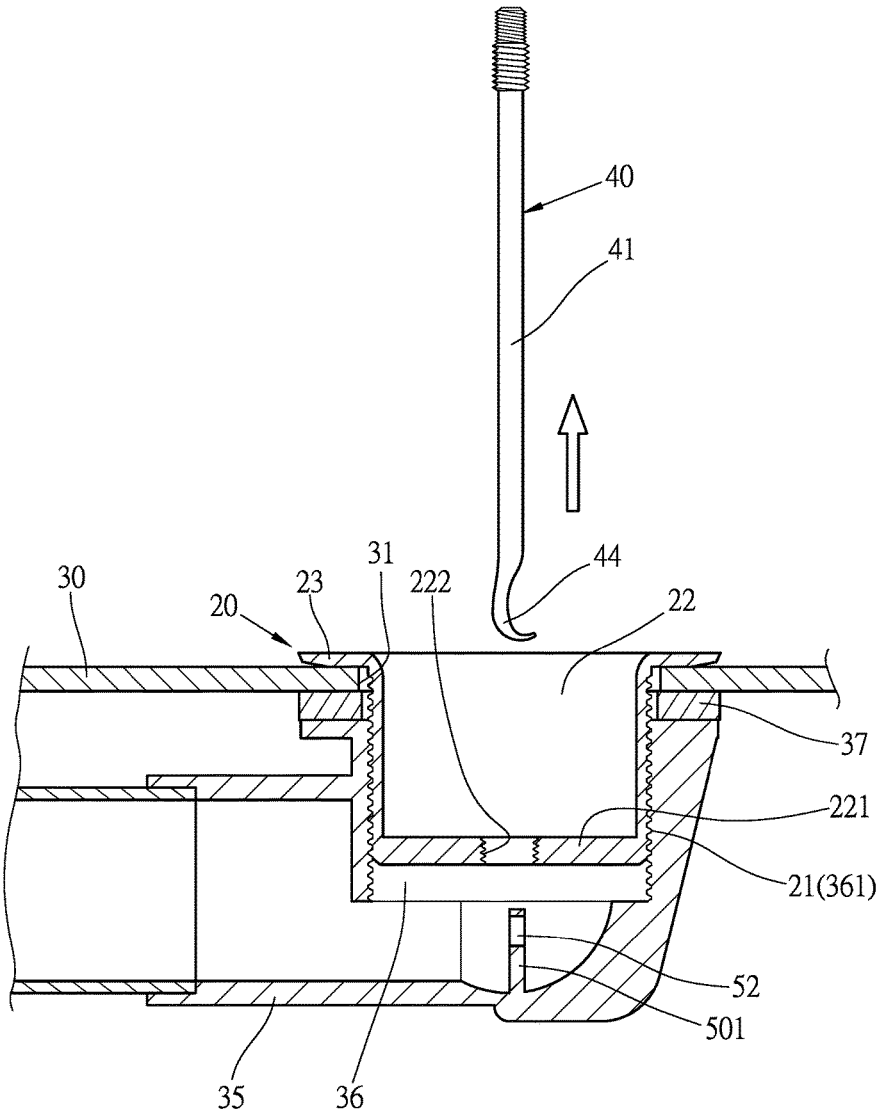
FIG. 16 shows that the guide member is separated from the extension of the tub shoe of the second embodiment of the drainage assembly of the present invention, and the base is connected to the tub shoe.

As shown in FIGS. 10 to 12, when replacing the stopper unit 10, the cover 11 is pressed downward, and the rod 41 is extended through the lock hole 222. The first connection portion 42 is threadedly and detachably connected to the threaded hole 51 of the extension 50. The washer 37 and the base 20 are replaced, and the user operates the guide member 40 to pull the drain pipe 35 and to align the tub shoe 36 with the new base 20. The outer threads 21 of the base 20 are connected with the inner threads 361 of the tub shoe 36 as shown in FIGS. 10 and 11. After the new base 20 is secured, the rod 41 is separated from the extension 50 as shown in FIG. 12.

It is noted that the diameter of the lock hole 222 is larger than the diameter of the rod 41, so that the rod 41 is restricted within the range of the lock hole 222, and this is benefit for guide the tub shoe 36 to a position where the drain passage 22 is located in alignment with the tub shoe 36. The tub shoe 36 is well positioned, so that the user may rotate the base 20 to easily connect the base 20 to the tub shoe 36. After the base 20 is secured, the rod 41 is rotated to separate the first connection portion 42, and the cover 11, the stopper 13 and the axle 14 can be installed. The threaded hole 51 of the extension 50 can be connected to either the first connection portion 42 or the second connection portion 43 as needed.

As shown in FIGS. 13 to 16, the rod 41 has a hook 44 formed on the second end thereof, and the extension 501 includes an aperture 52. The steps for replacing the base 20 will be the same as those disclosed in the previous embodiment, except for that the hook 44 is hooked to the aperture 52 of the extension 501.

Figure 17:
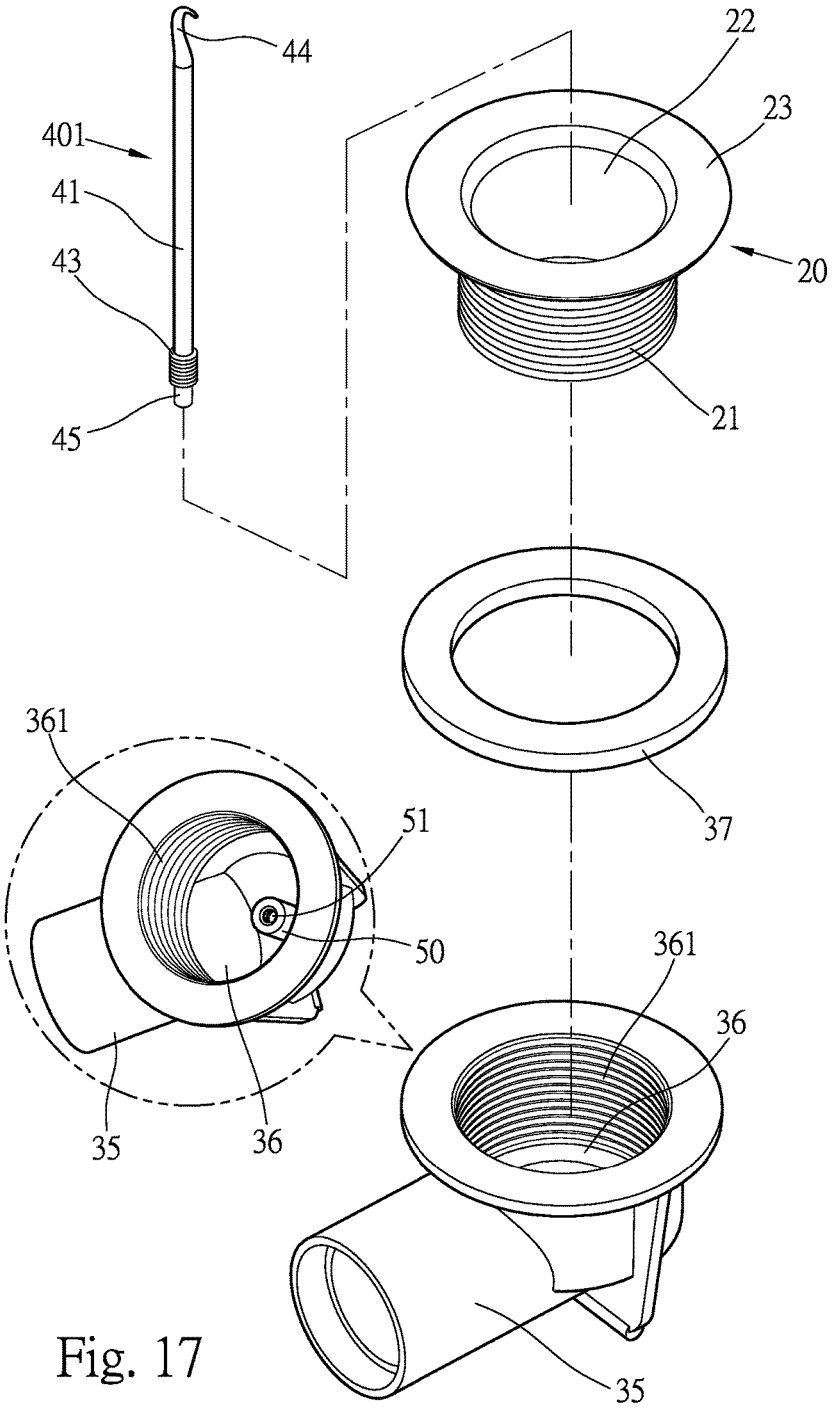
FIG. 17 is an exploded view to show the third embodiment of the drainage assembly of the present invention.
Figure 18:
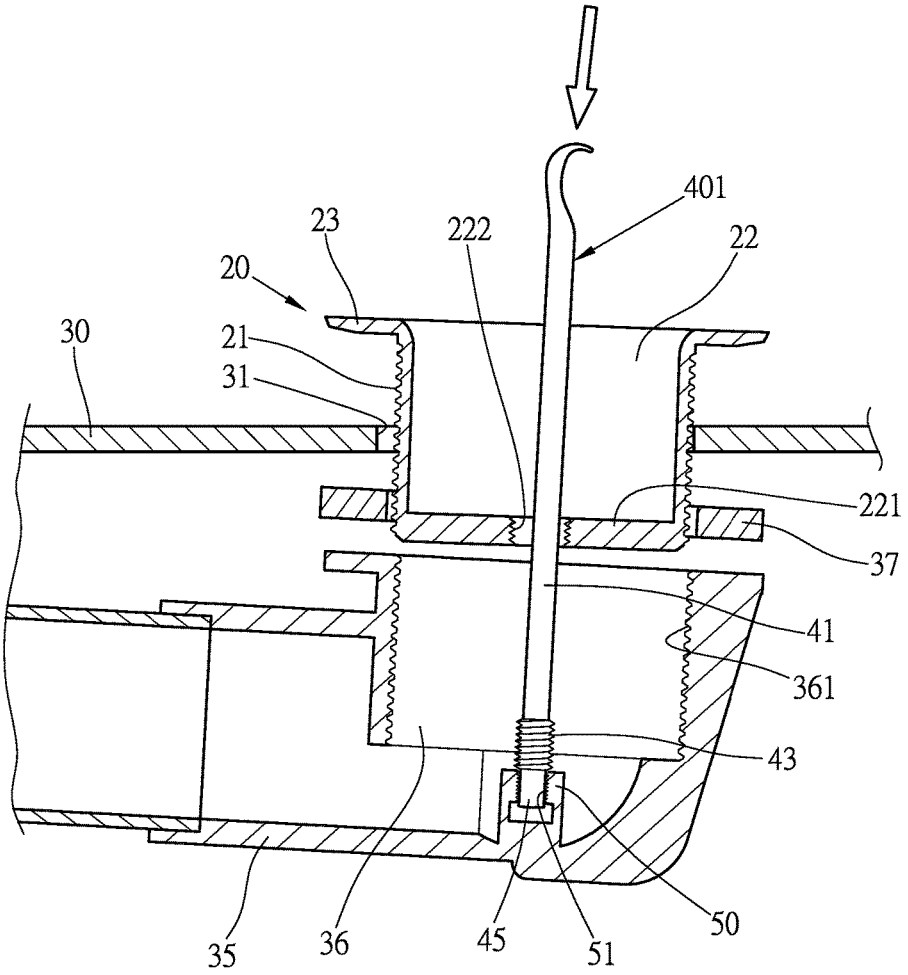
FIG. 18 shows that the guide member extends through the base and is threadedly connected to the extension of the tub shoe of the third embodiment of the drainage assembly of the present invention.

FIGS. 17 and 18 show that the first connection portion 45 of the guide member 401 is a resilient section, and the second connection portion 43 is formed on the rod 41 and located axially next to the first connection portion 45. The second connection portion 43 is a cylindrical section with outer threads. There is a hook 44 formed on the second end of the rod 41. The extension 50 includes a threaded hole 51 which is connected to one of the first and second connection portions 45, 43. It is noted that the diameter and length of the first connection portion 45 is larger than the inner diameter of the threaded hole 51 of the extension 50. Therefore, the first connection portion 45 is force-fitted into the threaded hole 51 by proper deformation of the first connection portion 45 so as to connect the rod 41 and the drain pipe 35. Therefore, the drain pipe 35 can be moved and guided by the guide member 401. The steps for replacing the base 20 will be the same as those disclosed in the first embodiment, except for that the first connection portion 45 is force-fitted into the threaded hole 51 of the extension 50.

When the base 20 is replaced, the user pulls the rod 41 to force the first connection portion 45 to deform and to separate from the threaded hole 51 of the extension 50. The cover 11, the stopper 13 and the axle 14 can then be installed.

While we have shown and described the embodiment in accordance with the present invention, it should be clear to those skilled in the art that further embodiments may be made without departing from the scope of the present invention.

What is claimed is:

1. A drainage assembly for a bathtub, comprising:

a stopper unit detachably coupled to a base, the base having outer threads, the base defining a drain passage and having a lock hole defined through a bottom surface thereof;

a drain pipe having a tub shoe at one end thereof, the tub shoe communicating with the drain passage, the tub shoe including inner threads defined in an inner periphery thereof to engage the outer threads of the base, an extension extending from an inner bottom of the tub shoe to be disposed beneath the base, the extension having a bottom end closed by the inner bottom of the tub shoe; and an elongate guide member including a rod having a diameter smaller than an inner diameter of the lock hole, a first connection portion formed at a first end of the rod, the first connection portion detachably connected to the extension of the tube shoe when the rod of the guide member is passed through the lock hole with the stopper unit detached from the base, the guide member being thereby connected to align the tub shoe with the base, and to connect the outer threads of the base with the inner threads of the tub shoe.

2. The drainage assembly as claimed in claim 1, wherein the rod has a hook formed on a second end thereof, and the extension includes an aperture to which the hook is hooked.

3. The drainage assembly as claimed in claim 1, wherein the first connection portion of the rod is a cylindrical end formed with outer threads, a second connection portion is formed on the rod and located axially next to the first connection portion, the second connection portion is a cylindrical section formed with outer threads, a diameter of the second connection portion is larger than that of the first connection portion, and the extension includes a threaded hole connected to one of the first and second connection portions.

4. The drainage assembly as claimed in claim 1, wherein the first connection portion of the guide member is a resilient section, a second connection portion is formed on the rod and located axially next to the first connection portion, the second connection portion is a cylindrical section formed with outer threads, the extension includes a threaded hole connected to one of the first and second connection portions, and a diameter and length of the first connection portion is larger than the threaded hole of the extension for force fit insert therein.

* * * * *